US011142705B2

(12) United States Patent
De Jonge et al.

(10) Patent No.: US 11,142,705 B2
(45) **Date of Patent: *Oct. 12, 2021**

(54) PROCESS FOR PREPARING A BASE OIL HAVING A REDUCED CLOUD POINT

(71) Applicant: SHELL OIL COMPANY, Houston, TX (US)

(72) Inventors: Diederik De Jonge, Amsterdam (NL); Edward Julius Creyghton, Amsterdam (NL); Eduard Philip Kieffer, Amsterdam (NL); Duurt Renkema, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/064,046

(22) PCT Filed: Dec. 23, 2016

(86) PCT No.: PCT/EP2016/082570
§ 371 (c)(1),
(2) Date: Jun. 20, 2018

(87) PCT Pub. No.: WO2017/109179
PCT Pub. Date: Jun. 29, 2017

(65) Prior Publication Data

US 2019/0002773 A1 Jan. 3, 2019

(30) Foreign Application Priority Data

Dec. 23, 2015 (EP) ..... 15202577

(51) Int. Cl.
*C10G 69/02* (2006.01)
*C10M 171/02* (2006.01)
(Continued)

(52) U.S. Cl.
CPC ..... *C10G 69/02* (2013.01); *C10G 65/043* (2013.01); *C10G 65/12* (2013.01); *C10M 105/02* (2013.01);
(Continued)

(58) Field of Classification Search
None
See application file for complete search history.

(56) References Cited

U.S. PATENT DOCUMENTS 1,978,010 A 10/1934 Carlisle et al.
1,981,758 A * 11/1934 Svanoe ..... C10G 73/06 208/33
(Continued)

FOREIGN PATENT DOCUMENTS

EP 0532118 A1 3/1993
EP 0666894 A 8/1995
(Continued)

OTHER PUBLICATIONS

International Search Report and Written Opinion received for PCT Patent Application No. PCT/EP2016/082570, dated Feb. 13, 2017, 9 pages.
(Continued)

*Primary Examiner* — Derek N Mueller
(74) *Attorney, Agent, or Firm* — Shell Oil Company

(57) ABSTRACT

The present invention relates to a process for preparing a residual base oil from a hydrocarbon feed which is derived from a Fischer-Tropsch process, the process comprises the steps of: (a) providing a hydrocarbon feed which is derived from a Fischer-Tropsch process; (b) subjecting the hydrocarbon feed of step (a) to a hydrocracking/hydroisomerisation step to obtain an at least partially isomerised product; (c) separating at least part of the at least partially isomerised product as obtained in step (b) into one or more lower
(Continued)

boiling fractions and a hydrowax residue fraction; (d) catalytic dewaxing of the hydrowax residue fraction of step (c) to obtain a highly isomerised product; (e) separating the highly isomerised product of step (d) into one or more light fractions and a isomerised residual fraction; (f) mixing of the isomerised residual fraction of step (e) with a diluent to obtain a diluted isomerised residual fraction; (g) cooling the diluted isomerised residual fraction of step (f) to a temperature between 0° C. and −60° C.; (i) subjecting the mixture of step (g) to a centrifuging step at a temperature between 0° C. and −60° C. to isolate the wax from the diluted isomerised residual fraction; (j) separating the diluent from the diluted isomerised residual fraction to obtain a residual base oil.

10 Claims, 1 Drawing Sheet

(51) Int. Cl.

| | |
|---|---|
| ***C10G 65/04*** | (2006.01) |
| ***C10G 65/12*** | (2006.01) |
| ***C10M 107/02*** | (2006.01) |
| ***C10M 105/02*** | (2006.01) |
| *C10N 20/02* | (2006.01) |
| *C10N 20/00* | (2006.01) |
| *C10N 30/02* | (2006.01) |
| *C10N 70/00* | (2006.01) |

(52) U.S. Cl.
CPC ..... *C10M 107/02* (2013.01); *C10M 171/02* (2013.01); *C10G 2300/1022* (2013.01); *C10G 2300/304* (2013.01); *C10G 2400/10* (2013.01); *C10M 2205/173* (2013.01); *C10N 2020/011* (2020.05); *C10N 2020/02* (2013.01); *C10N 2030/02* (2013.01); *C10N 2070/00* (2013.01)

(56) References Cited

U.S. PATENT DOCUMENTS

| | | | | |
|---|---|---|---|---|
| 2,036,966 | A * | 4/1936 | Jones | C10G 73/28 208/18 |
| 2,293,162 | A | 8/1942 | Montgomery | |
| 3,491,885 | A | 1/1970 | Hazard | |
| 3,654,128 | A | 4/1972 | Woodle | |
| 3,660,273 | A | 5/1972 | Cummins | |
| 3,670,888 | A | 6/1972 | Boroughs et al. | |
| 3,901,789 | A | 8/1975 | Michael et al. | |
| 4,096,168 | A | 6/1978 | Hallgren | |
| 4,343,692 | A | 8/1982 | Winquist | |
| 4,574,043 | A | 3/1986 | Chester et al. | |
| 4,820,400 | A | 4/1989 | Ryan et al. | |
| 4,859,311 | A | 8/1989 | Miller | |
| 4,892,822 | A | 1/1990 | Abramowicz et al. | |
| 4,911,821 | A | 3/1990 | Katzer et al. | |
| 4,919,788 | A | 4/1990 | Chen et al. | |
| 5,053,373 | A | 10/1991 | Zones | |
| 5,157,191 | A | 10/1992 | Bowes et al. | |
| 5,252,527 | A | 10/1993 | Zones | |
| 5,354,923 | A | 10/1994 | Schon et al. | |
| 5,589,564 | A | 12/1996 | Komiya et al. | |
| 5,885,438 | A | 3/1999 | Apelian et al. | |
| 6,384,178 | B2 | 5/2002 | Mizia et al. | |
| 7,674,363 | B2 | 3/2010 | Adams et al. | |
| 7,763,745 | B2 | 7/2010 | Van Der Heide et al. | |
| 8,685,231 | B2 | 4/2014 | Van De Graaf et al. | |
| 2004/0152861 | A1 | 8/2004 | Nefzger et al. | |
| 2010/0236990 | A1* | 9/2010 | Gleeson | C10G 29/02 208/289 |
| 2011/0083995 | A1 | 4/2011 | Gleeson et al. | |
| 2015/0203769 | A1* | 7/2015 | Kieffer | C10G 45/62 208/59 |

FOREIGN PATENT DOCUMENTS

| | | | |
|---|---|---|---|
| EP | 0776959 | A2 | 6/1997 |
| EP | 0807656 | A1 | 11/1997 |
| EP | 0832171 | B1 | 1/2000 |
| EP | 1134248 | A1 | 9/2001 |
| EP | 2341122 | A1 | 7/2011 |
| EP | 1029029 | B1 | 6/2013 |
| GB | 509181 | A | 7/1939 |
| GB | 1154069 | A | 6/1969 |
| JP | S6416826 | A | 1/1989 |
| WO | 9718278 | A1 | 5/1997 |
| WO | 0014179 | A1 | 3/2000 |
| WO | 0029511 | A1 | 5/2000 |
| WO | 02070627 | A2 | 9/2002 |
| WO | 03070857 | A1 | 8/2003 |
| WO | 2005047439 | A2 | 5/2005 |
| WO | 2006040319 | A1 | 4/2006 |
| WO | 2006040328 | A1 | 4/2006 |
| WO | 2007009975 | A1 | 1/2007 |
| WO | 2009080681 | A2 | 7/2009 |
| WO | 2013150114 | A2 | 10/2013 |
| WO | 2014001546 | A1 | 1/2014 |
| WO | 2014189879 | A1 | 11/2014 |
| WO | 2016107912 | A1 | 7/2016 |

OTHER PUBLICATIONS

Scherzer et al., "Reactions and Reaction Pathways", Hydrocracking Science and Technology, 1996, Chapter 6, 25 pages.
International Search Report and Written Opinion received for PCT Patent Application No. PCT/EP2016/082589, dated Feb. 6, 2017, 9 pages.
Sarpal et al., "Hydrocarbon Characterization of Hydrocracked Base Stocks by One- and Two-Dimensional NMR Spectroscopy", Fuel, Mar. 1996, vol. 75, Issue No. 4, pp. 483-490.
Makela et al., "Automating the NMR Analysis of Base Oils: Finding Napthene Signals", Fuel, Sep. 2013, vol. 111, pp. 543-554.
Zeng et al., "University Chemistry for Engineering Courses (second edition)", Jun. 30, 1995, pp. 267-268.
Office Action Received for Application No. 201680075879.3 , dated Dec. 2, 2019, 9 pages(7 pages of English Translation and 2 pages of Official Copy).
Zeolyst: "About Zeolyst Our Products Inv. Beta", Zeolyst Webpage, Jul. 9, 2015, XP055292507.
Costa et al., "Structural Analysis of Zeolite Beta through Periodic ab Initio simulations of Xrd and 29Si and 17O NMR Spectra", Journal of Molecular Structure, vol. 1097, May 14, 2015, pp. 112-116, XP029189070.
Perez-Pariente et al., "29Si and 27A1 MAS NMR Study of Zeolite beta with Different Si/A1 Ratios", Journal of catalysis, vol. 124, 1990, pp. 217-223, XP055292579.
Kunkeler et al., "Zeolite Beta: The Relationship between Calcination Procedure, Aluminum Configuration, and Lewis Acidity", Journal of Catalysis, vol. 180, Issue No. 2, Dec. 10, 1998, pp. 234-244, XP004447229.
Kadgaonkar et al., "Synthesis and Characterization of NCL-5, NCL-6 and NCL-7: New Zeolites Enriched With Polymorph B of the BEA Family", Microporous and Mesoporous Material, vol. 105, Issue No. 1-2, Sep. 7, 2007, pp. 82-88, XP022235370.
Kadgaonkar et al. "NCL-7, A Novel all Silica Analog of Polymorph B Rich Member of BEA Family: Synthesis and Characterization", Microporous and Mesoporous Materials, vol. 101, Issue No. 1-2, Mar. 29, 2007, pp. 108-114, XP022004512.
Fyfe et al., "Correlations Between Lattice Structures of Zeolites and their 29Si MAS NMR Spectra: Zeolites Kz-2, ZSM-12, and Beta", Zeolites, vol. 8, Mar. 31, 1988, pp. 132-136, XP055293684.
Wang et al., "Dealumination of Organic Structure-directing Agent (Usda) Free Beta Zeolite for Enhancing Its Catalytic Performance in N-hexane Cracking",Microporous and Mesoporous Materials, vol. 220, Sep. 15, 2015, pp. 275-281, XP029315079.
International Search Report and Written Opinion received for PCT Patent Application No. PCT/EP2017/084089 dated Feb. 19, 2018, 10 pages.

(56) References Cited

OTHER PUBLICATIONS

International Search Report and Written Opinion received for PCT Patent Application No. PCT/US2016/067672, dated Mar. 28, 2017, 8 pages.
International Search Report and Written Opinion received for PCT Patent Application No. PCT/US2016/067664, dated Mar. 29, 2017, 10 pages.
International Search Report and Written Opinion received for PCT Patent Application No. PCT/US2016/067666, dated Mar. 28, 2017, 8 pages.
Sequeira, Lubricant Base Oil and Wax Processing, Chapter 7, 1994, pp. 153-193.
Anonymous: "Oil Viscosity Explained", Apr. 29, 2015, XP055664125, Retrieved from the Internet: URL:https://web.archive.org/web/20150429073921/https://www.kewengineering.co.uk/Auto_oils/oil_viscosity_explained.htm, 9 pages.
International Search Report and Written Opinion received for PCT Patent Application No. PCT/EP2017/084105 dated Feb. 19, 2018, 11 pages.

* cited by examiner

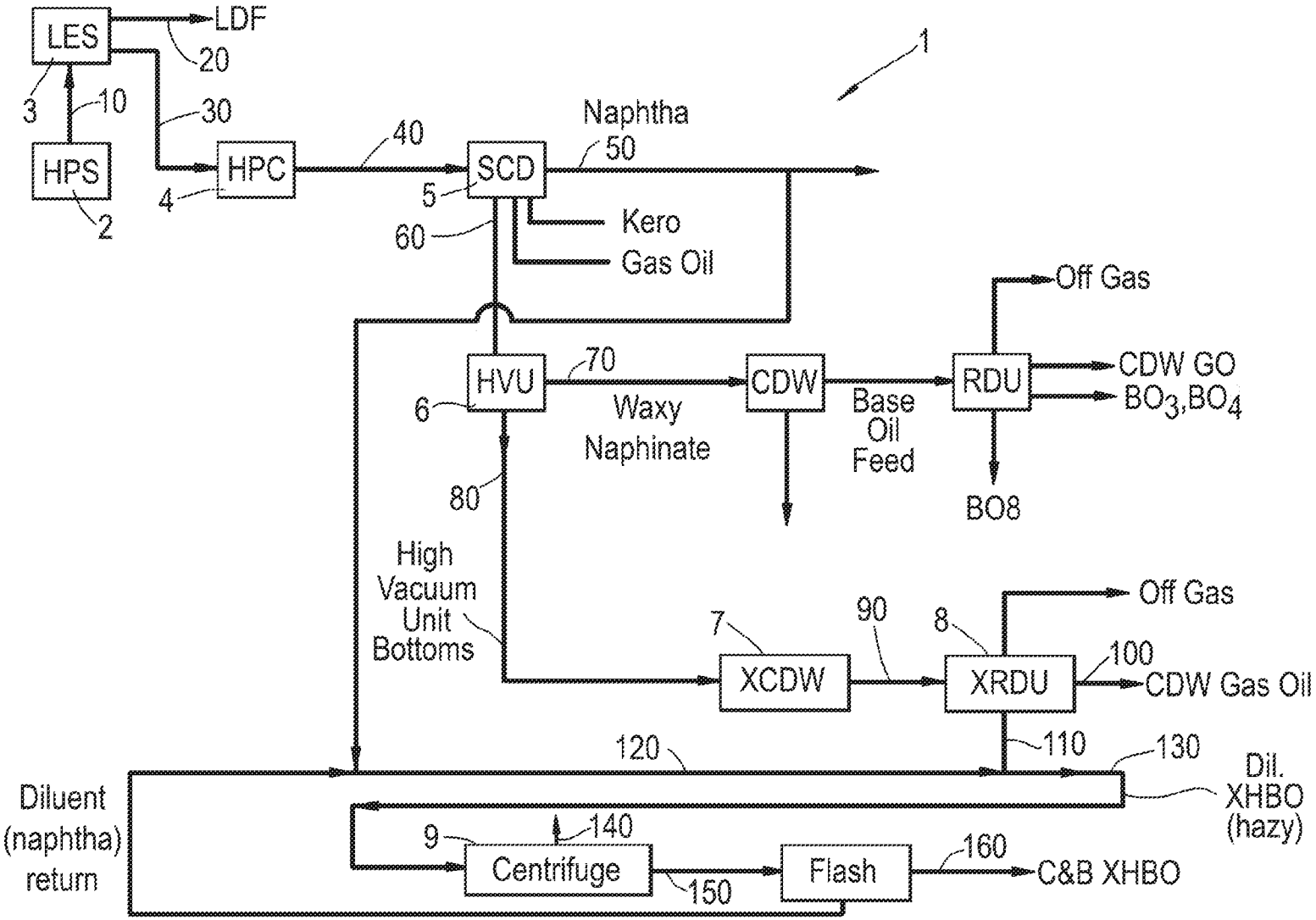
1
LDF
20
LES
3
10
HPS
2
30
HPC
4
40
Naphtha
50
SCD
5
Kero
Gas Oil
60
Off Gas
RDU
CDW GO
$BO_3$,$BO_4$
BO8
CDW
Base Oil Feed
70
HVU
6
Waxy Naphinate
80
High Vacuum Unit Bottoms
Off Gas
XRDU
8
CDW Gas Oil
100
XCDW
7
90
110
120
130
Dil. XHBO (hazy)
Flash
160
C&B XHBO
Centrifuge
9
140
150
Diluent (naphtha) return

PROCESS FOR PREPARING A BASE OIL HAVING A REDUCED CLOUD POINT

CROSS REFERENCE TO RELATED APPLICATIONS

This is a national stage application of International Application No. PCT/EP2016/082570, filed 23 Dec. 2016, which claims benefit of priority to European Patent Application No. 15202577.1, filed 23 Dec. 2015.

FIELD OF THE INVENTION

The present invention relates to a process for preparing a residual base oil.

BACKGROUND OF THE INVENTION

It is known in the art that waxy hydrocarbon feeds, including those synthesized from gaseous components such as CO and $H_2$, especially Fischer-Tropsch waxes, are suitable for conversion/treatment into base oils by subjecting such waxy feeds to hydroisomerization/hydrocracking whereby long chain normal-paraffins and slightly branched paraffins are removed and/or rearranged/isomerized into more heavily branched iso-paraffins of reduced pour and cloud point. Base oils produced by the conversion/treatment of waxy hydrocarbon feeds of the type synthesized from gaseous components (i.e. from Fischer-Tropsch feedstocks), are referred to herein as Fischer-Tropsch derived base oils, or simply FT base oils.

It is known in the art how to prepare so-called Fischer-Tropsch residual (or bottoms) derived base oils, referred to hereinafter as FT residual base oils. Such FT residual base oils are often obtained from a residual (or bottoms) fraction resulting from distillation of an at least partly isomerised Fischer-Tropsch feedstock. The at least partly isomerised Fischer-Tropsch feedstock may itself have been subjected to processing, such as dewaxing, before distillation. The residual base oil may be obtained directly from the residual fraction, or indirectly by processing, such as dewaxing. A residual base oil may be free from distillate, i.e. from side stream product recovered either from an atmospheric fractionation column or from a vacuum column. WO02/070627, WO2009/080681 and WO2005/047439 describe exemplary processes for making Fischer-Tropsch derived residual base oils.

FT base oils, have found use in a number of lubricant applications on account of their excellent properties, such as their beneficial viscometric properties and purity. The FT base oils, and in particular residual FT base oils can suffer from an undesirable appearance in the form of a waxy haze at ambient temperature. Waxy haze may be inferred or measured in a number of ways. The presence of waxy haze may for instance be measured according to ASTM D4176-04 which determines whether or not a fuel or lubricant conforms with a "clear and bright" standard. Whilst ASTM D4176-04 is written for fuels, it functions too for base oils. Waxy haze in FT residual base oils, which can also adversely affect the filterability of the oils, results from the presence of long carbon chain length paraffins, which have not been sufficiently isomerised (or cracked).

The content of long carbon chain length paraffins, which stem from the waxy hydrocarbon feed, is particularly high in residual fractions from which residual base oils are derived. Since the presence of long carbon chain length paraffins also causes pour point and cloud point to be relatively high, residual fractions are typically subjected to one or more catalytic and/or solvent dewaxing steps. Such dewaxing steps are highly effective in lowering the pour point and cloud point in the resulting FT residual base oils, and under some conditions can also help to mitigate or eliminate haze, especially when combined with filtering. However, there remains a need for improved effective and efficient solutions for mitigating haze in FT base oils, especially in residual base oils and residual base oils.

It is therefore an object of the invention to address the problems of waxy haze in FT residual base oils.

SUMMARY OF THE INVENTION

One of the above or other objects may be achieved according to the present invention by providing a process for preparing a residual base oil from a hydrocarbon feed which is derived from a Fischer-Tropsch process, the process comprises the steps of:

(a) providing a hydrocarbon feed which is derived from a Fischer-Tropsch process;

(b) subjecting the hydrocarbon feed of step (a) to a hydrocracking/hydroisomerisation step to obtain an at least partially isomerised product;

(c) separating at least part of the at least partially isomerised product as obtained in step (b) into one or more lower boiling fractions and a hydrowax residue fraction;

(d) catalytic dewaxing of the hydrowax residue fraction of step (c) to obtain a highly isomerised product;

(e) separating the highly isomerised product of step (d) into one or more light fractions and a isomerised residual fraction;

(f) mixing of the isomerised residual fraction of step (e) with a diluent to obtain a diluted isomerised residual fraction;

(g) cooling the diluted isomerised residual fraction of step (f) to a temperature between 0° C. and −60° C.;

(i) subjecting the mixture of step (g) to a centrifuging step at a temperature between 0° C. and −60° C. to isolate the wax from the diluted isomerised residual fraction;

(j) separating the diluent from the diluted isomerised residual fraction to obtain a residual base oil.

It has now surprisingly been found according to the present invention that the hazy appearance of the waxy haze in FT residual base oils can eliminated effectively when these base oils are subjected to a centrifuging step.

The base oils prepared in accordance with the present invention will stay haze free (60 days base oils storage stability test at zero ° C.) also after long storage times.

A further advantage is that the Fischer-Tropsch derived residual base oil has a reduced cloud point compared to the cloud point of that Fischer-Tropsch derived residual base oil prior to the centrifugation step. In this way, the values of the pour point and cloud point of the Fischer-Tropsch derived residual base oil according to the present invention are closer to each other than the values of the pour point and the cloud point of the Fischer-Tropsch derived residual base oil prior to the centrifuging step.

DETAILED DESCRIPTION OF THE INVENTION

In step (a) of the process according to the present invention a hydrocarbon feed which is derived from a Fischer-Tropsch process is provided.

The hydrocarbon feed as provided in step (a) is derived from a Fischer-Tropsch process. Fischer-Tropsch product stream is known in the art. By the term "Fischer-Tropsch product" is meant a synthesis product of a Fischer-Tropsch process. In a Fischer-Tropsch process synthesis gas is converted to a synthesis product. Synthesis gas or syngas is a mixture of hydrogen and carbon monoxide that is obtained by conversion of a hydrocarbonaceous feedstock. Suitable feedstock include natural gas, crude oil, heavy oil fractions, coal, biomass and lignite. A Fischer-Tropsch product derived from a hydrocarbonaceaous feedstock which is normally in the gas phase may also be referred to a GTL (Gas-to-Liquids) product. The preparation of a Fischer-Tropsch product has been described in e.g. WO2003/070857.

The product stream of the Fischer-Tropsch process is usually separated into a water stream, a gaseous stream comprising unconverted synthesis gas, carbon dioxide, inert gasses and C1 to C3, and a C4+ stream.

The full Fischer-Tropsch hydrocarbonaceous product suitably comprises a C1 to C300 fraction.

Lighter fractions of the Fischer-Tropsch product, which suitably comprises C3 to C9 fraction are separated from the Fischer-Tropsch product by distillation thereby obtaining a Fischer-Tropsch product stream, which suitably comprises C10 to C300 fraction.

The above weight ratio of compounds having at least 60 or more carbon atoms and compounds having at least 30 carbon atoms in the Fischer-Tropsch product is preferably at least 0.2, more preferably 0.3.

In step (b) of the process according to the present invention the hydrocarbon feed of step (a) is subjected to a hydrocracking/hydroisomerisation step to obtain an at least partially isomerized product.

It has been found that the amount of the isomerised product is dependent on the hydrocracking/hydroisomerization conditions. Hydrocracking/hydroisomerization processes are known in the art and therefore not discussed here in detail.

Hydrocracking/hydroisomerization and the effect of hydrocracking/hydroisomerization conditions on the amount of isomerised product are for example described in Chapter 6 of "Hydrocracking Science and Technology", Julius Scherzer; A. J. Cruia, Marcel Dekker, Inc, New York, 1996, ISBN 0-8247-9760-4.

In step (c) of the process at least a part of the at least partially isomerised product as obtained in step (b) is separated into one or more lower boiling fractions and a hydrowax residue. Preferably the whole stream is separated.

Suitably, the entire at least partially isomerised product as obtained in step (b) is separated in step (c) into one or more lower boiling fractions and a hydrowax residue. Suitably, the one or more distillate range carbon fractions as obtained in step (c) have a boiling point in the range of from 40-400° C., preferably in the range of from 60-380° C. The separation in step (c) is suitably carried out by means of distillation. The separation in step (c) may be performed by performing a distillation at atmospheric pressure to obtain an atmospheric hydrowax residue or under vacuum conditions to obtain a vacuum hydrowax residue. The separation in step (c) may also include a first atmospheric distillation followed by a further distillation of the atmospheric hydrowax residue at vacuum distillation conditions to obtain the vacuum hydrowax residue. With the production of a vacuum hydrowax residue a further waxy raffinate fraction is separated having a boiling point in the range of from 340-560° C., preferably 360-520° C.

In step (d) of the process according to the present invention the hydrowax residue fraction of step (c) is catalytic dewaxed to obtain a highly isomerized product. The catalytic dewaxing process in step (d) may be any process wherein in the presence of a catalyst and hydrogen the pour point of the base oil precursor fraction (=hydrowax residue fraction) is reduced. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably, the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35, ZSM-48, EU-2 and MCM-68. Another preferred group of molecular sieves are the silica-aluminaphosphate (SAPO) materials of which SAPO-Il is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, Ni/ZSM-5, Pt/ZSM-23, Pd/ZSM-23, Pt/ZSM-48, Pt/EU-2 and Pt/SAPO-11. Further details and examples of suitable molecular sieves and dewaxing conditions are for example described in WO-A-9718278, U.S. Pat. Nos. 4,343,692, 5,053,373, 5,252,527, 4,574,043, WO-A-0014179 and EP-A-1029029. The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate pore size zeolite crystallites as described above and a low acidity refractory oxide binder material which is essentially free of alumina as described above, wherein the alumina content of the aluminosilicate zeolite crystallites and especially the surface of said zeolite crystallites has been modified by subjecting the aluminosilicate zeolite crystallites to a surface dealumination treatment. Steaming is a possible method of reducing the alumina content of the crystallites. A preferred dealumination treatment is by contacting an extrudate of the binder and the zeolite with an aqueous solution of a fluorosilicate salt as described in for example U.S. Pat. No. 5,157,191 or WO-A-0029511. This method is believed to selectively dealuminate the surface of the zeolite crystallites. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171.

More preferably the molecular sieve is a MTW, MTT or TON type molecular sieve, of which examples are described above, the Group VIII metal is platinum or palladium and the binder is silica.

Preferably, the catalytic dewaxing in step (b) is performed in the presence of a catalyst as described above wherein the zeolite has at least one channel with pores formed by 12-member rings containing 12 oxygen atoms. Preferred zeolites having 12-member rings are of the MOR type, MTW type, FAU type, or of the BEA type (according to the framework type code). Preferably, a MTW type, for example ZSM-12, zeolite is used. A preferred MTW type zeolite containing catalyst also comprises as a platinum or palladium metal as Group VIII metal and a silica binder. More preferably the catalyst is a silica bound AHS treated Pt/ZSM-12 containing catalyst as described above. These 12-member ring type zeolite based catalysts are preferred because they have been found to be suitable to convert waxy paraffinic compounds to less waxy iso-paraffinic compounds.

Catalytic dewaxing conditions are known in the art and typically involve operating temperatures in the range of from 200-500° C., suitably from 250-400° C., hydrogen pressures in the range of from 10-200 bara, preferably from 30-100 bara, weight hourly space velocities (WHSV) in the range of from 0.1-10 kg of oil per litre of catalyst per hour (kg/l/hr), suitably from 0.2-5 kg/l/hr, more suitably from 0.3-2 kg/l/hr and hydrogen to oil ratios in the range of from 100-2,000 litres, suitably in the range of from 200-1500 litres of hydrogen per kilogram of oil.

In step (e) of the process according to the present Invention the highly isomerized product of step (d) is separated into one or more light fractions and an isomerized residual fraction.

Suitably, the entire at highly isomerized product as obtained in step (d) is separated in step (e) into one or more light fractions and a isomerized residual fraction. Suitably, the one or more light carbon fractions as obtained in step (e) with effective cut-point in the range of from 350-650 C, suitably from 400-600 C and most preferably 450-550 C. The separation in step (e) is suitably carried out by means of distillation. The separation in step (e) may be performed by performing a distillation at atmospheric pressure or under vacuum conditions. The separation in step (e) may also include a first atmospheric distillation followed by a further distillation at vacuum distillation conditions.

The isomerized residual fraction as obtained in step (f) comprises a residual base oil and microcrystalline wax. At ambient temperature the FT derived residual base oil often shows a hazy appearance that is typically due to the presence of a small quantity of the microcrystalline wax particles.

In step (f) of the process according to the present invention, the isomerised residual fraction of step (e) is mixed with a diluent to obtain a diluted isomerised residual fraction.

Suitably, the diluent is added to the isomerised residual fraction in step (f) such that the ratio of diluent to isomerised residual fraction is of from 1:1 to 10:1, preferably from 1:1 to 3:1, more preferably from 1:1 to 2:1.

Preferably, the diluent of step (f) is a hydrocarbon stream which forms a single liquid phase with the liquid phase of the isomerised residual fraction.

The diluent preferably has a low viscosity and is miscible with the liquid phase of the isomerised residual fraction of step (e). Also, above a temperature of −60° C., the diluent may be still liquid. The density difference between the diluent and the microcrystalline wax may preferably be above 0.05 g/ml.

The diluent of step (f) is preferably selected from the group consisting of petroleum spirit, naphtha, kerosene, single component paraffin liquids in a carbon range of from 8 to 16 carbon atoms, low boiling point polar compounds with a temperature in the range of from 40 to 280° C. such as alcohols, ketones or ethers and combinations or two or more thereof. More preferably, the diluent is petroleum spirit or a FT derived paraffinic naphtha fraction.

In step (g) of the process according to the present invention the diluted isomerised residual fraction of step (f) is cooled to a temperature between 0 and −60° C. Preferably, the diluted isomerised residual fraction in step (g) is cooled to a temperature in the range of from −5 to −50° C., more preferably in the range of from −10 to −35° C.

Suitably, the cooling temperature is not higher than the target cloud point. Preferably, the cooling temperature is at least 10° C. lower than the target cloud point. For example, if the target cloud point is 0° C., then the cooling temperature is at least lower than −10° C.

In step (i) of the process according to the present invention the cooled diluted isomerised residual fraction of step (g) is subjected to a centrifuging step at a temperature between 0 and −60° C. to isolate the microcrystalline wax from the diluted isomerised residual fraction.

Preferably, the temperature at the centrifuging step in step (i) is similar to the temperature of the cooling step in step (g). Suitably, the cooled diluted isomerised residual fraction of step (g) is subjected to the centrifuging step in step (i) at a temperature in the range of from −5 to −50° C., more preferably in the range of from −10 to −35° C.

As described above, at these low temperatures the diluent is preferably still a liquid and miscible with the isomerised residual fraction and the diluent preferably has a high density difference with the microcrystalline wax.

Typically, after the centrifuging step of step (i) two phases are obtained. One phase may comprise the solid microcrystalline wax and the second is a liquid phase comprising the diluted residual base oil.

The centrifugation conditions, such as centrifugation time, temperature, relative centrifugal force (RCF) (times gravity (*g)) are dependent on the centrifuge being used. Centrifugation processes are known in the art and therefore not discussed here in detail.

Centrifugation and the effect of centrifugation conditions on the rate of separation of solid and liquid are for example described in Leung, W. W-F (1998), Industrial Centrifugation Technology, McGraw-Hill Professional, New York, ISBN-13:978-0070371910, ISBN-10:0070371911.

The yield of microcrystalline wax obtained after the centrifugation step in step (i) is preferably between 2 to 30 wt. % on the basis of the total amount of isomerised residual fraction.

In step (j) of the process according to the present invention the diluent is separated from the diluted residual base oil to obtain the residual base oil.

The yield of the residual base oil obtained after the separation step in step (j) is between 70 and 98 wt. % on total isomerized residual fraction.

Suitably, the diluent as obtained after being separated from the residual base oil in step (j) is recycled to step (f).

In a further aspect the present invention provides a Fischer-Tropsch derived residual base oil obtainable by the process according to the present invention.

Preferably, the Fischer-Tropsch derived residual base oil according to the present invention has a kinematic viscosity according to ASTM D445 at 100° C. according to ASTM in the range of from 15 to 35 cSt, a pour point of less than −10° C. and a cloud point of less than 0° C.

FIG. 1 schematically shows a process scheme of the process scheme of a preferred embodiment of the process according to the present invention.

For the purpose of this description, a single reference number will be assigned to a line as well as a stream carried in that line.

The process scheme is generally referred to with reference numeral 1.

From a Fischer-Tropsch process reactor 2 a Fischer-Tropsch product stream 10 is obtained. This product is separated in a distillation column 3 into a fraction 20 boiling below a temperature in the range of 150 to 250° C. at atmospheric conditions and a fraction 30 boiling above a temperature in the range 250° C. at atmospheric conditions. The high boiling fraction 30 is fed to a hydrocracking/hydroisomerization reactor 4 wherein part of the components boiling above a temperature in the range of 250° C. are converted to product boiling below a temperature in the range of from 300 to 450° C. The partially isomerized effluent 40 of reactor 4 is distilled in a synthetic crude distillation column (SCD) 5 to recover a middle distillates fraction 50 and a atmospheric hydrowax residue fraction 60. Optionally, the effluent 60 is distilled in a high vacuum unit (HVU) to recover a waxy raffinate fraction 70 and a vacuum hydrowax residue fraction 80. The hydrowax residue 80 or 60 is fed to a catalytic dewaxing reactor 7 to obtain a highly isomerized product fraction 90. The effluent 90 of reactor 7 is distilled in a RDU redistillation unit 8 to recover a catalytic dewaxed gas oil fraction 100 and a hazy isomerized residual fraction 110. Fraction 110 is mixed with a diluent 120 to obtain a diluted isomerized residual fraction 130. Fraction 130 is cooled to a temperature between 0 and −60° C. (not shown). The cooled fraction 130 is subjected to a centrifuge unit 9 at a temperature between 0 and −60° C. to isolate a wax fraction 140 and a diluted residual base oil 150 from the diluted isomerized residual fraction 130. Fraction 150 is subjected to a flash column to separate the diluent 120 from the diluted residual base oil fraction to obtain a clear and bright base oil 160.

The present invention is described below with reference to the following Examples, which are not intended to limit the scope of the present invention in any way.

EXAMPLES

Example 1

From a Fischer Tropsch wax product, through a hydrocracking step (60 bar, 330-360° C.) and subsequent atmospheric and vacuum distillation a vacuum hydrowax residue was obtained (congealing point=103° C.). This vacuum hydrowax residue was subjected to a catalytic dewaxing step at 40 bara, WHSV=0.5 kg/l/hr, hydrogen to oil ratio 750 N1/kg, WABT=320° C. and subsequent batch atmospheric distillation followed by vacuum distillation. The isomerized residual fraction, with a density of D70/4=0.805, a kinematic viscosity according to ASTM D445 at 100° C. of 21.2 $mm^2/s$, a pour point of PP=−24° C. and a cloud point of cp=42° C., was mixed with Petroleum Ether 40/60) in a ratio of 2 parts by weight of diluent to 1 part by weight of isomerized residual fraction. The diluted isomerized residual fraction was cooled to a temperature of −30° C. The cooled diluted isomerized residual fraction was exposed to a high rotation speed of 14000 RPM (equivalent to a Relative Centrifugal Force (RCF)=21000 g force) in a cooled laboratory centrifuge for a period of 10 minutes. Separation of microcrystalline wax and diluted residual base oil was obtained by decantation. The Petroleum Ether was flashed from the diluted residual base oil in a laboratory rotavap apparatus in a temperature range 90-140° C. and 300 mbar pressure. The base oil obtained was found to be clear and bright at a temperature of 0° C. for a period of 7 hours. The kinematic viscosity according to ASTM D445 at 100° C. of the base oil at a temperature of 100° C. was 18.9 $mm^2/s$, a viscosity index of 153, a pour point was measured of pp=−42° C. and a cloud point of cp=−20° C. (see table 1).

Example 2

In a second experiment according to the invention, the vacuum hydrowax residue used in experiment 1 was subjected to a dewaxing step operated at the same conditions that were applied in Example 1. Subsequently, the catalytic dewaxing unit effluent was distilled with a laboratory continuous atmospheric column in series with a short path distillation unit. The isomerized residual fraction, with a density of D70/4=0.805, a kinematic viscosity according to ASTM D445 at 100° C. of 21.3 $mm^2/s$, a pour point of PP=−39° C. and a cloud point of cp=39° C., was mixed with Petroleum Ether 40/60) in a ratio of 2 parts by weight of diluent to 1 part by weight of isomerized residual fraction. The diluted isomerized residual fraction was cooled to a temperature of −60° C. The cooled diluted isomerized residual fraction was exposed to a lower rotation speed than in experiment 1 of 9157 RPM (equivalent to a Relative Centrifugal Force (RCF=9000 g force) in a laboratory centrifuge cooled to −20° C. for a period of 5 minutes. After this, the sample was cooled again to −60° C. and the centrifuge step of 5 minutes was repeated (at the same conditions as the first centrifuge step). Thereafter, separation of microcrystalline wax and diluted residual base oil was obtained by decantation. The Petroleum Ether was flashed from the diluted residual base oil in a laboratory rotavap apparatus in a temperature range 90-140° C. and 300 mbar pressure. The base oil obtained was found to be clear and bright at a temperature of 0° C. for a period of 7 hours, a kinematic viscosity according to ASTM D445 at 100° C. of the base oil at a temperature of 100° C. was 19.2 $mm^2/s$, a cloud point of cp=−15° C. (see table 1).

Comparative Example 3

In a comparative experiment, the vacuum hydrowax residue used in experiment 1 was subjected to a dewaxing step operated at the same conditions that were applied in Example 1. In a third experiment not according to the invention Subsequently, the catalytic dewaxing unit effluent was distilled with a laboratory continuous atmospheric column in series with a short path distillation unit, as in example 2. The isomerized residual fraction, with a density of D70/4=0.805, a kinematic viscosity according to ASTM D445 at 100° C. of 21.3 mm2/s, a pour point of PP=−39° C. and a cloud point of cp=39° C., was mixed with Petroleum Ether (40/60) in a ratio of 2 parts by weight of diluent to 1 part by weight of isomerized residual fraction. The diluted isomerized residual fraction was cooled to a temperature of −20° C. In order to separate the microcrystalline wax and diluted residual base oil, the cooled diluted isomerized residual fraction was filtered with a stack of Whatmann filter papers (41/42/41) in a laboratory batch filtration device that was maintained at temperature of −20° C. The Whatmann filter 41 has been specified with a pore size from 20 to 25 μm and the Whatmann filter 42 with a pore size of 2.5 μm. The Petroleum Ether was flashed from the diluted residual base oil in a laboratory rotavap apparatus in a temperature range 90-140° C. and 300 mbar pressure. The base oil obtained was found to be hazy at a temperature of 0° C., a kinematic viscosity according to ASTM D445 at 100° C. of the base oil at a temperature of 100° C. was 21.0 mm2/s, a cloud point of cp=+26° C. (see table 1).

Comparative Example 4

In a comparative fourth experiment not according to the invention, the vacuum hydrowax residue used in experiment 1 was subjected to a dewaxing step operated at the same conditions that were applied in Example 1. Subsequently, the catalytic dewaxing unit effluent was distilled with a laboratory continuous atmospheric column in series with a short path distillation unit as in example 2. The isomerized residual fraction, with a density of D70/4=0.805, a kinematic viscosity according to ASTM D445 at 100° C. of 21.3 mm2/s, a pour point of PP=−39° C. and a cloud point of cp=39° C., was mixed with heptane in a ratio of 4 parts by weight of diluent to 1 part by weight of isomerized residual fraction. The diluted isomerized residual fraction was cooled to a temperature of −25° C. In order to separate the microcrystalline wax and diluted residual base oil, the cooled diluted isomerized residual fraction was filtered with a stack of Whattmann filter papers (41/42/41) in a laboratory batch filtration device that was maintained at temperature of −25° C. The Whatmann filter 41 has been specified with a pore size from 20 to 25 μm and the Whatmann filter 42 with a pore size of 2.5 μm. The heptane was flashed from the diluted residual base oil in a laboratory rotavap apparatus in a temperature range 90-140° C. and 300 mbar pressure. The base oil obtained was found to be hazy at a temperature of 0° C., a kinematic viscosity according to ASTM D445 at 100° C. of the base oil at a temperature of 100° C. was 20.6 mm2/s, a cloud point of cp=+19° C. (see table 1).

TABLE 1

| Properties base oil | Example 1 | Example 2 | Comparative Example 3 | Comparative Example 4 |
|---|---|---|---|---|
| Kinematic viscosity at 100° C. (cSt) | 18.9 | 19.2 | 21.0 | 20.6 |
| Pour point (° C.) | −42 | −42 | −30 | −30 |
| Cloud point (° C.) | −20 | −15 | +26 | +19 |
| Appearance at 0° C. | Clear and bright | Clear and bright | hazy | hazy |

Discussion

Examples 1 and 2 show that in both experiments using the centrifuging step a clear and bright Fischer-Tropsch derived residual base oil is obtained. In addition, the cloud points of the base oils in Example 1 and 2 have been reduced significantly compared to the cloud points before the centrifugation step. Also the kinematic viscosity at 100° C. of the clear and bright base oil is comparable to the isomerized residual fraction which indicates that the centrifuging method does not influence the kinematic viscosity of the base oil.

Comparative examples 3 and 4 show that in both experiments using a filtration step a hazy Fischer Tropsch derived residual base oil is obtained. In addition, the cloud points of the base oils in comparative Examples 3 and 4 have only been reduced moderately compared to the cloud points before the filtration step. In both cases, cloud point remains far above zero ° C.

That which is claimed is:

1. A process for preparing a residual base oil from a hydrocarbon feed which is derived from a Fischer-Tropsch process, the process comprising the steps of:

(a) providing a hydrocarbon feed which is derived from a Fischer-Tropsch process;

(b) subjecting the hydrocarbon feed of step (a) to a hydrocracking/hydroisomerisation step to obtain an at least partially isomerised product;

(c) separating at least part of the at least partially isomerised product as obtained in step (b) into one or more lower boiling fractions and a hydrowax residue fraction;

(d) catalytic dewaxing of the hydrowax residue fraction of step (c) to obtain a highly isomerised product;

(e) separating the highly isomerised product of step (d) into one or more light fractions and an isomerised residual fraction;

(f) mixing of the isomerised residual fraction of step (e) with a diluent to obtain a diluted isomerised residual fraction;

(g) cooling the diluted isomerised residual fraction of step (f) to a temperature between 0° C. and −60° C.;

(h) subjecting the mixture of step (g) to a centrifuging step at a temperature between 0° C. and −60° C. to isolate the wax from the diluted isomerised residual fraction; and (i) separating the diluent from the diluted isomerised residual fraction to obtain a residual base oil, wherein the residual base oil is haze-free at 0° C. and has a reduced cloud point compared to the cloud point of the base oil prior to the centrifugation step (h).

2. The process according to claim 1, wherein the diluent is added to the isomerised residual fraction in step (f) such that the ratio of diluent to isomerised residual fraction is of from 1:1 to 10:1.

3. The process according to claim 1, wherein the diluent of step (f) is a hydrocarbon stream which forms a single liquid phase with the liquid phase of the isomerised residual fraction.

4. The process according to claim 3, wherein the diluent of step (f) is selected from the group consisting of petroleum spirit, naphtha, kerosene, single component paraffin liquids in a carbon range of from 8 to 16 carbon atoms, and low boiling point polar compounds, wherein the low boiling point polar compounds have a boiling point in the range from 40 to 280° C. and consist of one or more of alcohols, ketones, ethers, and combinations thereof.

5. The process according to claim 3, wherein the diluent is selected from the group consisting of petroleum spirit and FT derived paraffinic naphtha fraction.

6. The process according to claim 1, wherein the diluted isomerised residual fraction in step (g) is cooled to a temperature in the range of from −5° C. to −50° C.

7. The process according to claim 1, wherein the diluent of step (i) is recycled to step (f).

8. The process according to claim 1, wherein the diluent is added to the isomerised residual fraction in step (f) such that the ratio of diluent to isomerised residual fraction is of from 1:1 to 3:1.

9. The process according to claim 1, wherein the diluent is added to the isomerised residual fraction in step (f) such that the ratio of diluent to isomerised residual fraction is of from 1:1 to 2:1.

10. The process according to claim 1, wherein the diluted isomerised residual fraction in step (g) is cooled to a temperature in the range of from −10° C. to −35° C.

* * * * *